US009025996B2

(12) United States Patent
Taguchi

(10) Patent No.: US 9,025,996 B2
(45) Date of Patent: May 5, 2015

(54) METHODS AND DEVICES FOR REMANUFACTURING PRINTER CARTRIDGE COMPONENTS

(71) Applicant: Mitsubishi Kagaku Imaging Corporation, San Fernando, CA (US)

(72) Inventor: Susumu Taguchi, Odawara (JP)

(73) Assignee: Mitsubishi Kagaku Imaging Corporation, Glendale, CA (US)

( * ) Notice: Subject to any disclaimer, the term of this patent is extended or adjusted under 35 U.S.C. 154(b) by 0 days.

(21) Appl. No.: 13/987,441

(22) Filed: Jul. 25, 2013

(65) Prior Publication Data

US 2014/0029977 A1 Jan. 30, 2014

Related U.S. Application Data

(60) Provisional application No. 61/741,720, filed on Jul. 25, 2012.

(51) Int. Cl.
*G03G 21/18* (2006.01)
*G03G 15/00* (2006.01)

(52) U.S. Cl.
CPC ..... *G03G 21/181* (2013.01); *G03G 15/757* (2013.01); *G03G 2215/00987* (2013.01)

(58) Field of Classification Search
CPC combination set(s) only.
See application file for complete search history.

(56) References Cited

U.S. PATENT DOCUMENTS 5,461,464 A * 10/1995 Swain ..... 399/159
2009/0162093 A1* 6/2009 Shanun et al. ..... 399/109
2014/0010570 A1* 1/2014 Galaviz Martinez ..... 399/109

* cited by examiner

*Primary Examiner* — Clayton E Laballe
*Assistant Examiner* — Jas Sanghera

(57) ABSTRACT

A method for remanufacturing a printer cartridge component is provided. The method provides a printer cartridge component having an assembled organic photoconductor (OPC) drum with a flange portion and a cylinder portion. The flange portion has a cylinder engagement end attached and inserted in a locked position with a flange lock in a first end of the cylinder portion. The method further unlocks the flange lock so that the flange portion is in an unlocked position in the first end of the cylinder portion. The method further secures the unlocked flange portion. The method further removes the cylinder portion from the secured unlocked flange portion to obtain a removed cylinder portion and a removed flange portion. The method further assembles the removed flange portion with a replacement OPC drum cylinder portion to obtain a remanufactured printer cartridge component.

20 Claims, 14 Drawing Sheets

98
60b
58b
44
14
42

90
95
80a
98
5B
60b
58b
36
16
14
42
74
28
42
66
51
91
12
26
60a
58a
98
92
80b
94
76
90
93
11

METHODS AND DEVICES FOR REMANUFACTURING PRINTER CARTRIDGE COMPONENTS

CROSS REFERENCE TO RELATED APPLICATION

This application claims the benefit of U.S. Provisional Patent Application Ser. No. 61/741,720, filed Jul. 25, 2012, which is incorporated herein by reference in its entirety.

BACKGROUND a. Field of the Invention

The invention relates to methods and devices for remanufacturing printer cartridge components, and in particular, to methods and devices for remanufacturing laser printer cartridge components by remanufacturing used organic photoconductor (OPC) flange portions of assembled OPC drums flanges and attaching or assembling such used OPC flange portions to replacement OPC drum cylinder portions.

b. Background Art

Printer cartridges, such as toner cartridges, are used in various electrophotographic imaging devices, such as laser printers, copiers, facsimile machines, and multifunction imaging devices. Once original equipment manufacturer (OEM) printer cartridges are used, they are often recycled and remanufactured. The process of remanufacturing a printer cartridge may include cleaning the cartridge, repairing damaged parts, replacing worn parts, reassembling with new parts, and replenishing the cartridge with toner. The process of remanufacturing a printer cartridge requires that the printer cartridge be disassembled so that access to the various parts can be achieved, and further requires that the printer cartridge be reassembled for subsequent use.

Printer cartridges typically include organic photoconductive (OPC) drums that may be designed to be electrically charged to be able to attract toner. An assembled OPC drum typically comprises a cylinder portion and a flange or gear portion, where the flange portion may be inserted into one end of the cylinder portion and may be attached to that end of the cylinder portion with an adhesive or glue and/or a known attachment or assembly process. One known attachment or assembly process may include a crimping process that involves crimping or pinching of the end of the cylinder portion once the flange portion is inserted in order to keep the flange portion in place. The OPC drum cylinder portion may wear out from usage at a faster rate than the flange portion and may need to be replaced during remanufacturing, while the flange portion may be reused. However, the flange portion may be attached to the OPC drum cylinder portion in a manner that makes the flange portion difficult to remove from the OPC drum cylinder portion, and when removal of the flange portion from the OPC drum cylinder portion is attempted, such removal may cause damage to the flange portion, so that the flange portion could not be reused. For example, such known assembled OPC drums with attached flange portions for color laser printer applications may include a flange lock on the flange portion that helps to lock the flange portion in place and/or to lock the flange portion to the OPC drum cylinder portion. Further, such flange portion may also include a grounding plate with contact portions attached to the flange portion.

During remanufacturing of such known OPC flange portions attached to known OPC drum cylinder portions, known hand tools, such as screwdrivers, pliers, spring hooks, and scraping tools, may be typically used to pry off and separate the flange portion from the OPC drum cylinder portion and/or may be used to push out and remove the flange portion from the OPC drum cylinder portion in order to remove the flange portion from the OPC drum cylinder portion. However, if not used carefully and properly, such known hand tools may damage the flange portion, for example, may damage the plastic walls of the flange portion, or may damage the grounding plate or contact portions of the grounding plate, or other portions of the flange portion. In particular, damage to the plastic walls of the flange portion or damage to the grounding plate or contact portions of the grounding plate may affect or prevent reuse and remanufacturing of the used flange portion with a replacement OPC drum cylinder portion.

It is thus desirable to be able to remove and replace the used flange portion on a used flanged OPC drum without damage to the used flange portion, including, for example, the plastic walls of the flange portion, the grounding plate of the flange portion, and the contact portions of the grounding plate. This helps preserve the appearance of the used flange portion and the ability to reuse and reassemble the used flange portion, and minimizes remanufacturing steps. Devices and methods for efficiently and quickly removing a used OPC flange portion from a used OPC drum cylinder portion, and reusing the used OPC flange portion with a replacement or new OPC drum cylinder portion are desired.

Accordingly, there is a need for an improved method and device for remanufacturing printer cartridge components, including reusing used OPC flange portions of assembled OPC drums and attaching or assembling such used OPC flange portions to replacement OPC drum cylinder portions, that overcomes the issues associated with known devices and methods.

SUMMARY

This need for an improved method and device for remanufacturing printer cartridge components, including reusing used OPC flange portions of assembled OPC drums and attaching or assembling such used OPC flange portions to replacement OPC drum cylinder portions, is satisfied.

There is provided in one embodiment a method for remanufacturing a printer cartridge component. The method comprises providing a printer cartridge component comprising an assembled organic photoconductor (OPC) drum having a flange portion and a cylinder portion. The flange portion has a cylinder engagement end attached and inserted in a locked position with a flange lock in a first end of the cylinder portion. The method further comprises unlocking the flange lock so that the flange portion is in an unlocked position in the first end of the cylinder portion. The method further comprises securing the unlocked flange portion. The method further comprises removing the cylinder portion from the secured unlocked flange portion to obtain a removed cylinder portion and a removed flange portion. The method further comprises assembling the removed flange portion with a replacement OPC drum cylinder portion to obtain a remanufactured printer cartridge component.

There is provided in another embodiment a method for removing a flange portion of an assembled organic photoconductive (OPC) drum. The method comprises providing an assembled organic photoconductor (OPC) drum having a flange portion and a cylinder portion. The flange portion has a cylinder engagement end attached and inserted in a locked position with a flange lock in a first end of the cylinder portion. The flange portion further comprises a flange projection end. The flange lock has a first flange lock portion and a second flange lock portion. The method further comprises providing a flange lock unlocking device. The flange lock unlocking device comprises an unlocking portion having a flange projection engagement end with a first claw portion and a second claw portion. The flange lock unlocking device further has a flange portion retaining element and a base portion attached to the unlocking portion. The method further comprises coupling the flange projection end of the flange portion to the flange projection engagement end of the flange lock unlocking device. The method further comprises inserting a first tip of the first claw portion into the first flange lock portion and inserting a second tip of the second claw portion into the second flange lock portion. The method further comprises unlocking the flange lock with the first claw portion and the second claw portion, so that the flange portion is in an unlocked position in the first end of the cylinder portion. The method further comprises securing the unlocked flange portion to the flange portion retaining element. The method further comprises removing the cylinder portion from the secured unlocked flange portion to obtain a removed cylinder portion and a removed flange portion.

There is provided in another embodiment an organic photoconductor (OPC) drum flange removal assembly for removing a flange portion from a cylinder portion of an assembled organic photoconductive (OPC) drum. The OPC drum flange removal assembly comprises a flange lock unlocking device. The flange lock unlocking device comprises an unlocking portion and a base portion attached to the unlocking portion. The unlocking portion comprises a flange projection engagement end adapted to receive a flange portion of an assembled OPC drum. The unlocking portion further comprises a first claw portion and a second claw portion both adapted to unlock a flange lock that locks a flange portion to a cylinder portion of the assembled OPC drum in order to obtain an unlocked flange portion. The unlocking portion comprises a flange portion retaining element having a first C-shaped hand element and a second C-shaped hand element adapted to grasp and secure the unlocked flange portion. The flange lock unlocking device further comprises a power source coupled to the flange lock unlocking device. The flange lock unlocking device unlocks the flange lock, so that the flange portion is in an unlocked position. The flange portion retaining element secures the unlocked flange portion, so that a cylinder portion can be removed from the secured unlocked flange portion to obtain a removed cylinder portion and a removed flange portion.

The above description sets forth, rather broadly, a summary of the disclosed embodiments so that the detailed description that follows may be better understood and contributions of the invention to the art may be better appreciated. Some of the disclosed embodiments may not include all of the features or characteristics listed in the above summary. There may be, of course, other features of the disclosed embodiments that will be described below and may form the subject matter of claims. The features, functions, and advantages that have been discussed can be achieved independently in various embodiments of the disclosure or may be combined in yet other embodiments further details of which can be seen with reference to the following description and drawings.

DESCRIPTION OF DRAWINGS

The invention can be better understood with reference to the following detailed description taken in conjunction with the accompanying drawings which illustrate preferred and exemplary embodiments, but which are not necessarily drawn to scale, wherein.

DETAILED DESCRIPTION

Disclosed embodiments will now be described more fully herein after with reference to the accompanying drawings, in which some, but not all disclosed embodiments are shown. Indeed, several different embodiments may be provided and should not be construed as limited to the embodiments set forth herein. Rather, these embodiments are provided so that this disclosure will be thorough and complete and will fully convey the scope of the disclosure to those skilled in the art. It is to be understood that other embodiments may be utilized and structural changes may be made without departing from the scope of the invention. Also, it is to be understood that the phraseology and terminology employed herein are for the purpose of description and should not be regarded as limiting.

The order in which the steps are presented below is not limited to any particular order and does not necessarily imply that they have to be performed in the order presented. It will be understood by those of ordinary skill in the art that the order of these steps can be rearranged and performed in any suitable manner. It will further be understood by those of ordinary skill in the art that some steps may be omitted or added and still fall within the spirit of the invention.

The disclosed embodiments provide various devices and methods for remanufacturing printer cartridges, such as toner cartridges, and in particular, for removing and replacing an organic photoconductor ("OPC") drum in a printer cartridge and installing a replacement OPC drum in a printer cartridge. The disclosed embodiments of the devices and methods may be used with printer cartridge components that can be used in laser printer models, such as Hewlett Packard Corporation HP1215, HP2600, HP2025, HP3525, HP425 families of laser printers, or other HP laser printer models, and may also be used with other suitable printer cartridges.

Figure 13:
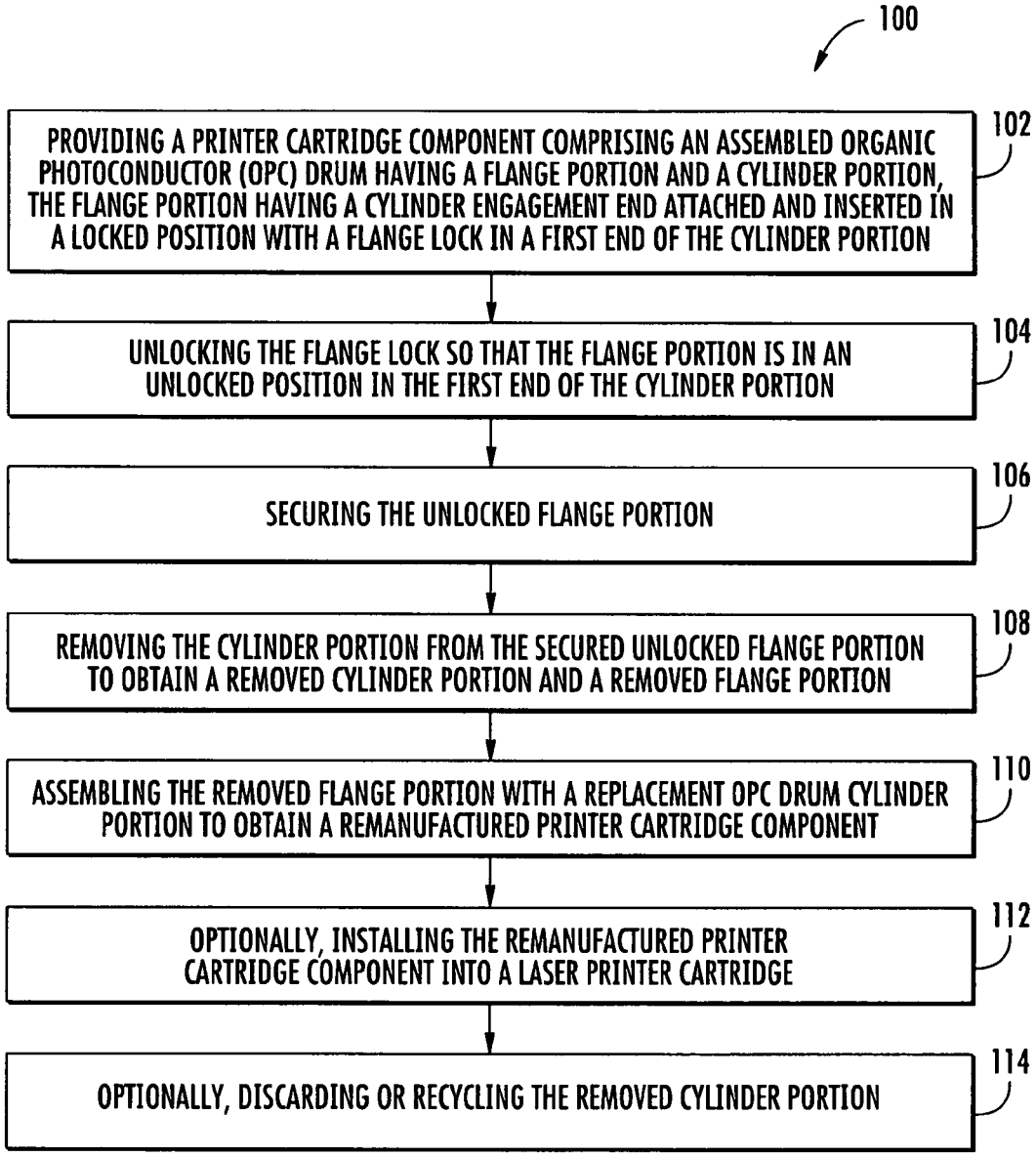
FIG. 13 is a flow diagram of one of the embodiments of a method for remanufacturing a printer cartridge component of the disclosure; and, FIG. 14 is a flow diagram of one of the embodiments of a method for method for removing a flange portion of an assembled organic photoconductive (OPC) drum of the disclosure.

Referring to the Figures, FIG. 13 a flow diagram of one of the embodiments of a method 100 for remanufacturing a printer cartridge component 10 of the disclosure. There is provided in one embodiment a method 100 for remanufacturing a printer cartridge component 10. As shown in FIG. 13, the method 100 comprises step 102 of providing a printer cartridge component 10 comprising an assembled organic photoconductor (OPC) drum 12. Preferably, the assembled organic photoconductor (OPC) drum 12 is a used assembled organic photoconductor (OPC) drum 13.

Figures 1A, 1B, 1C:
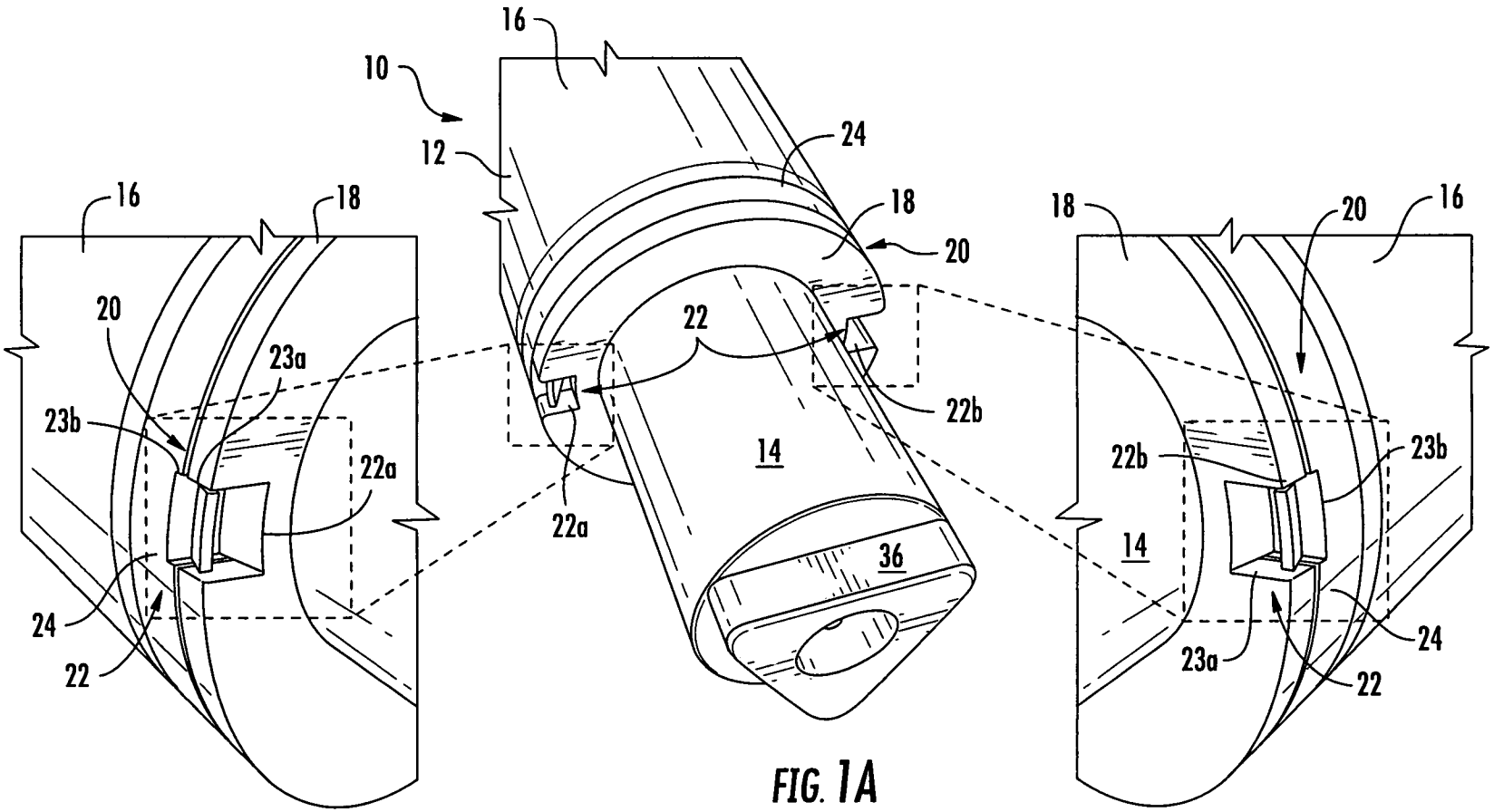
FIG. 1A shows a front top perspective view of a first flange lock portion and a second flange lock portion of a known OPC flange portion attached to a known OPC cylinder portion for which disclosed embodiments of the methods and device of the disclosure may be applied.
FIG. 1B shows a front side perspective close-up view of the first flange lock portion of FIG. 1A for which disclosed embodiments of the methods and device of the disclosure may be applied.
FIG. 1C shows a front side perspective close-up view of the second flange lock portion of FIG. 1A for which disclosed embodiments of the methods and device of the disclosure may be applied.
Figure 11B:
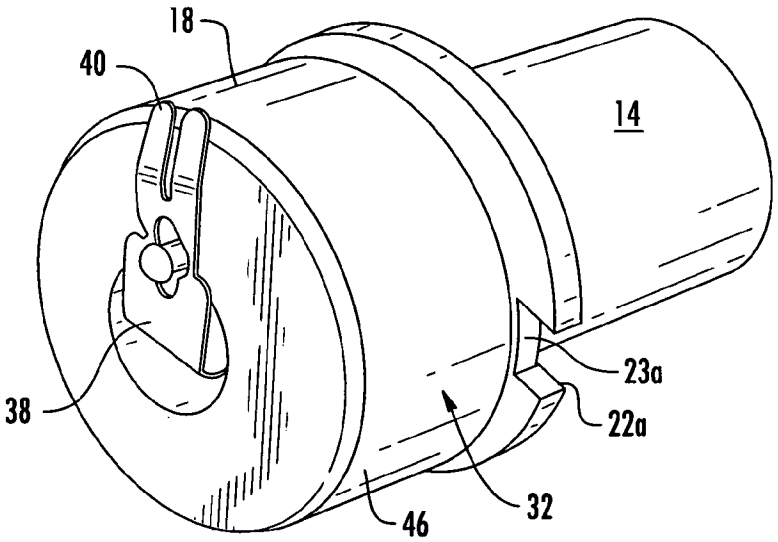
FIG. 11B is a top perspective view of the removed flange portion completely disconnected or removed from the removed cylinder portion.

The assembled organic photoconductor (OPC) drum 12 has a flange portion 14 and a cylinder portion 16. As shown in FIG. 11B, the flange portion 14 may have a grounding plate 38 with one or more contact portions 40. As shown in FIG. 1B, the flange portion 14 has a cylinder engagement end 18 attached and inserted in a locked position 20 with a flange lock 22 in a first end 24 of the cylinder portion 16.

FIG. 1A shows a front top perspective view of a printer cartridge component 10, such as in the form of an assembled and flanged organic photoconductor (OPC) drum 12. As shown in FIG. 1A, the printer cartridge component 10 comprises a flange portion 14, such as a known OPC flange portion, having a flange projection end 36 and a drum cylinder engagement end 18. As further shown in FIG. 1A, the printer cartridge component 10 comprises a cylinder portion 16, such as a known OPC drum cylinder portion. The cylinder portion 16 has a first end 24 (see FIG. 1B) attached to the drum cylinder engagement end 18.

FIG. 1A further shows a front top perspective view of a flange lock 22 having a first flange lock portion 22*a* and a second flange lock portion 22*b* of a flange portion 14, such as the known OPC flange portion, attached to a cylinder portion 16, such as the known OPC cylinder portion, for which disclosed embodiments of the method 100 (see FIG. 13) and method 200 (see FIG. 14) and flange lock unlocking device 50 and organic photoconductor (OPC) drum flange removal assembly 11 of the disclosure may be applied. As further shown in FIG. 1A, the first flange lock portion 22*a* is preferably positioned opposite the second flange lock portion 22*b*. The flange portion 14 further has a flange projection end 36.

FIG. 1B shows a front side perspective close-up view of the first flange lock portion 22*a* of the flange lock 22 of FIG. 1A for which disclosed embodiments of the method 100 (see FIG. 12) and method 200 (see FIG. 13) and devices of the disclosure may be applied. As shown in FIG. 1B, the first flange lock portion 22*a* comprises a flange notch 23*a* and a cylinder notch 23*b*. As further shown in FIG. 1B, the flange notch 23*a* and the cylinder notch 23*b* correspond to each other when the flange lock 22 is in the locked position 20.

FIG. 1C shows a front side perspective close-up view of the second flange lock portion 22*b* of the flange lock 22 of FIG. 1A for which disclosed embodiments of the method 100 (see FIG. 13) and method 200 (see FIG. 14) and devices of the disclosure may be applied. As shown in FIG. 1C, the second flange lock portion 22*b* comprises a flange notch 23*b* and a cylinder notch 23*b*. As further shown in FIG. 1B, the flange notch 23*a* and the cylinder notch 23*b* correspond to each other when the flange lock 22 is in the locked position 20 (see FIG. 1A).

Figures 5A, 5B:
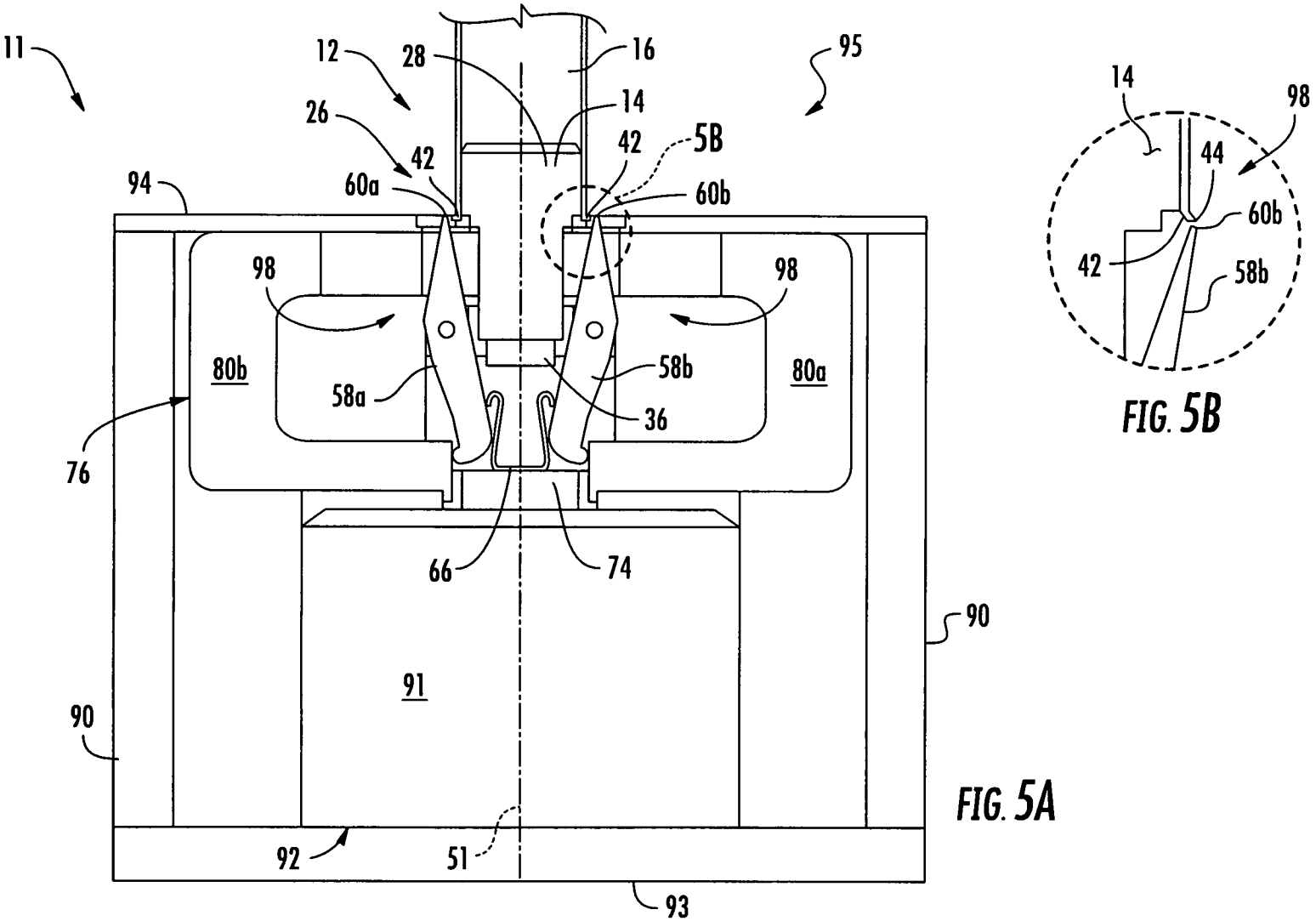
FIG. 5A is a side sectional view of an embodiment of an OPC drum flange removal assembly showing the flange lock unlocking device with first and second claw portions in an open position and with one end of a flange portion of as assembled OPC drum inserted into a corresponding opening of the flange lock unlocking device of the disclosure.
FIG. 5B is a close-up view of the circled portion 5B of FIG. 5A.

As shown in FIG. 13, the method 100 further comprises step 104 of unlocking the flange lock 22 (see FIG. 1A) so that the flange portion 14 (see FIG. 5A) is in an unlocked position 26 (see FIG. 5A) in the first end 24 (see FIG. 1A) of the cylinder portion 16 (see FIG. 5A). As shown in FIG. 13, the method 100 further comprises step 106 of securing the unlocked flange portion 28 (see FIG. 5A). As shown in FIG. 13, the method 100 further comprises step 108 of removing the cylinder portion 16 (see FIG. 9) from the secured unlocked flange portion 28 (see FIG. 5A) to obtain a removed cylinder portion 30 (see FIGS. 10, 11A) and a removed flange portion 32 (see FIGS. 10, 11A). Preferably, the removed flange portion 32 (see FIGS. 10, 11A) is not damaged during the removal step 108 of the method 100.

Figure 11A:
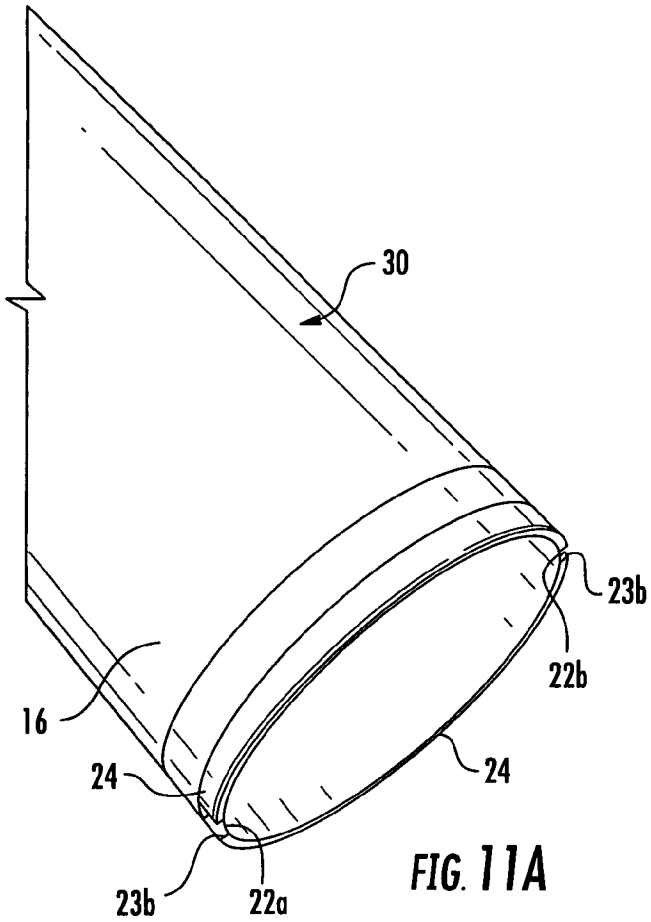
FIG. 11A is a top perspective view of the removed cylinder portion completely disconnected or removed from the removed flange portion.
Figure 12A:
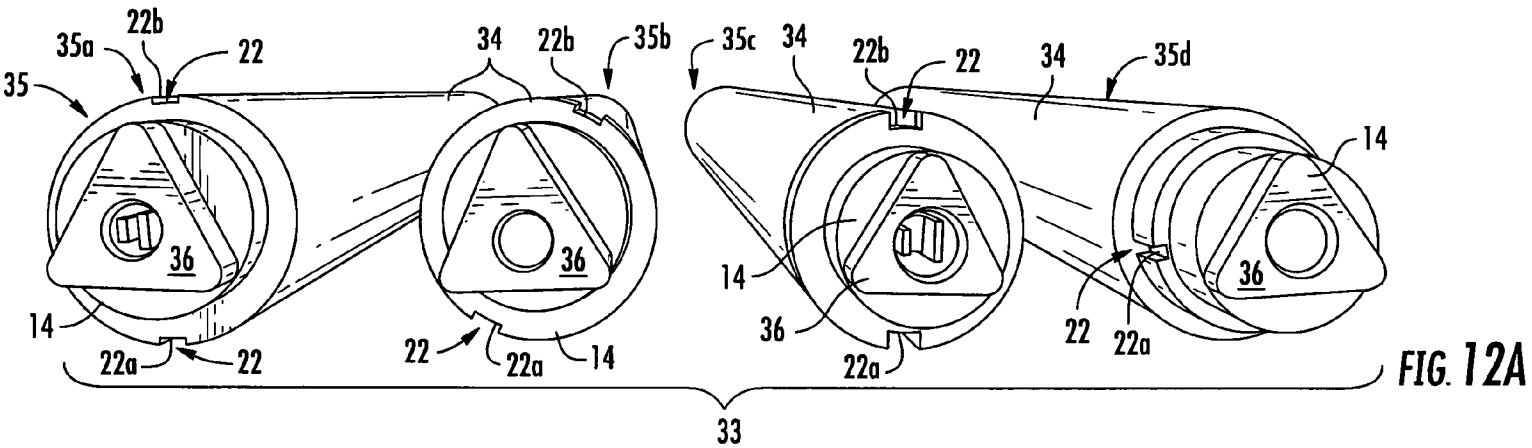
FIG. 12A is a front perspective view of various remanufactured printer cartridge components for color printing applications.

As shown in FIG. 13, the method 100 further comprises step 110 of assembling the removed flange portion 32 (see FIGS. 10, 11A) with a replacement OPC drum cylinder portion 34 (see FIG. 12A) to obtain a remanufactured printer cartridge component 33 (see FIG. 12A), such as in the form of a remanufactured assembled OPC drum 35 (see FIG. 12A).

As shown in FIG. 13, the method 100 may further optionally comprise step 112 of installing the remanufactured printer cartridge component 36 (see FIG. 12A) into a laser printer cartridge (not shown) for use in a laser printer machine (not shown). As shown in FIG. 13, the method 100 may further optionally comprise step 114 of discarding or recycling the removed cylinder portion 30 (see FIG. 11A). The method 100 may comprise a manual method or an automated method.

Figure 2B:
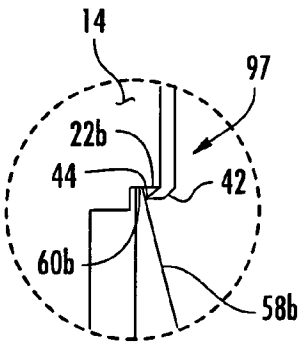
FIG. 2B is a close-up view of the circled portion 2B of FIG. 2A.
Figure 2A:
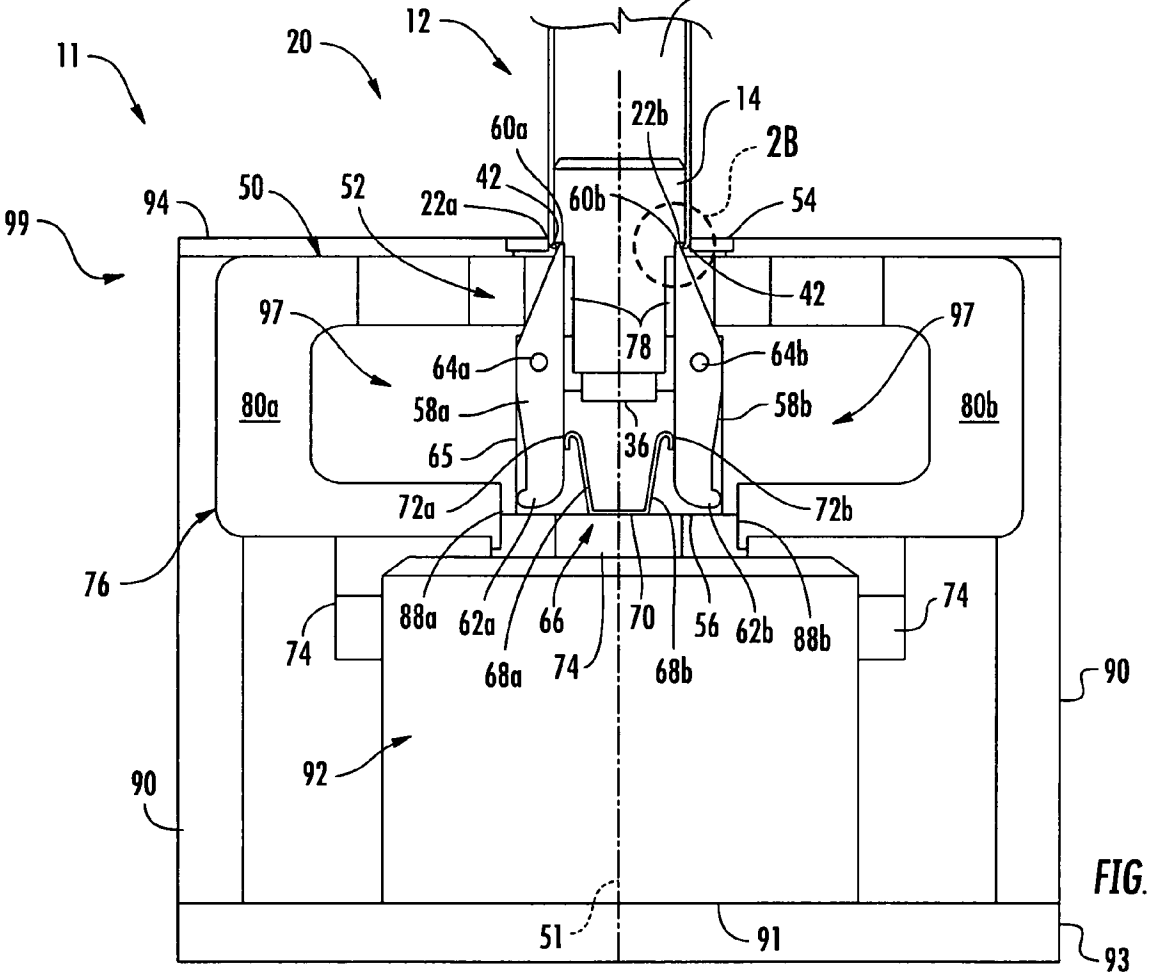
FIG. 2A is a side sectional view of an embodiment of an OPC drum flange removal assembly showing a flange lock unlocking device with first and second claw portions in a closed position and in contact with one end of a flange portion of an assembled OPC drum inserted into a corresponding opening of the flange lock unlocking device of the disclosure.

As shown in FIG. 2A, there is provided in another embodiment an organic photoconductor (OPC) drum flange removal assembly 11 for removing a flange portion 14 (see FIG. 1A) from a cylinder portion 16 (see FIG. 1A) of an assembled organic photoconductive (OPC) drum 12 (see FIG. 1A). The OPC drum flange removal assembly 11 (see FIG. 2A) comprises a flange lock unlocking device 50 (see FIG. 2A). The flange lock unlocking device 50 (see FIG. 2A) comprises an unlocking portion 52 (see FIG. 2A) and a base portion 74 (see FIG. 2A) attached to the unlocking portion 52 (see FIG. 2A).

FIG. 2A is a side sectional view of an embodiment of the OPC drum flange removal assembly 11 showing the flange lock unlocking device 50 with first and second claw portions 58*a*, 58*b* in a closed position 97 and in contact with one end of the flange portion 14 of the known assembled OPC drum 12 inserted into a corresponding opening of the flange lock unlocking device 50 of the disclosure. FIG. 2B is a close-up view of the circled portion 2B of FIG. 2A.

FIG. 5A is a side sectional view of an embodiment of the OPC drum flange removal assembly 11 showing the flange lock unlocking device 50 with first and second claw portions 58*a*, 58*b* in an open position 98 and with one end of the flange portion 14 of the known assembled OPC drum 12 inserted into a corresponding opening of the flange lock unlocking device 50. FIG. 5B is a close-up view of the circled portion 5B of FIG. 5A.

As shown in FIG. 2A, the flange lock unlocking device 50 comprises an unlocking portion 52 having a flange projection engagement end 54 and a base end 56. As further shown in FIG. 2A, the flange projection engagement end 54 is adapted to receive the flange projection end 36 of the flange portion 14 of the assembled OPC drum 12. As further shown in FIG. 2A, the unlocking portion 52 comprises a first claw portion 58*a* having a first tip 60*a* and a first base end 62*a*. The first claw portion 58*a* further comprises a first pivot element 64*a* (see FIG. 2A). As further shown in FIG. 2A, the unlocking portion 52 further comprises a second claw portion 58*b* having a second tip 60*b* and a second base end 62*b*. The second claw portion 58*b* further comprises a second pivot element 64*b* (see FIG. 2A). The first claw portion 58*a* is preferably positioned opposite the second claw portion 58*b*. As further shown in FIG. 2A, the first claw portion 58*a* and the second claw portion 58*b* may preferably be held in position with a claw holding element 65.

FIG. 2B is a close-up view of the circled portion 2B of FIG. 2A. FIG. 2B shows the second claw portion 58*b* in a closed position 97. As further shown in FIG. 2B, the second tip 60*b* of the second claw portion 58*b* is positioned in the second flange lock portion 22*b* of the flange portion 14. As further shown in FIG. 2B, the second tip 60*b* is positioned adjacent a tip 44 of a notch portion 42 of the second flange lock portion 22*b* in the locked position 20 (see FIG. 1A).

As shown in FIG. 2A, a spring element 66 may be positioned between the first claw portion 58*a* and the second claw portion 58*b*. As further shown in FIG. 2A, the spring element 66 may comprise a first spring portion 68*a*, a second spring portion 68*b*, and a spring base portion 70. The spring element 66 may comprise a plate spring or another suitable spring element known in the art. As further shown in FIG. 2A, the first spring portion 68*a* is preferably in spring tension contact with a first interior side 72*a* of the first claw portion 58*a*, and the second spring portion 68*b* is preferably in spring tension contact with a second interior side 72*b* of the second claw portion 58*b*. As further shown in FIG. 2A, the spring base portion 70 is preferably coupled to a base portion 74 with a coupling element 75 such as a bolt, screw or other suitable coupling or attachment means.

The first claw portion 58*a* (see FIG. 5A) and the second claw portion 58*b* (see FIG. 5A) are both adapted to unlock the flange lock 22 (see FIG. 1A) locking or that locks the flange portion 14 (see FIG. 5A) to the cylinder portion 16 (see FIG. 5A) of the assembled OPC drum 12 (see FIG. 1A) in order to obtain an unlocked flange portion 28 (see FIG. 5A).

As further shown in FIG. 2A, the unlocking portion 52 further comprises a flange portion retaining element 76. As further shown in FIG. 2A, the flange portion retaining element 76 may comprise a first C-shaped hand element 80*a* and a second C-shaped hand element 80*b* for grasping or holding the flange portion 14.

Figure 3:
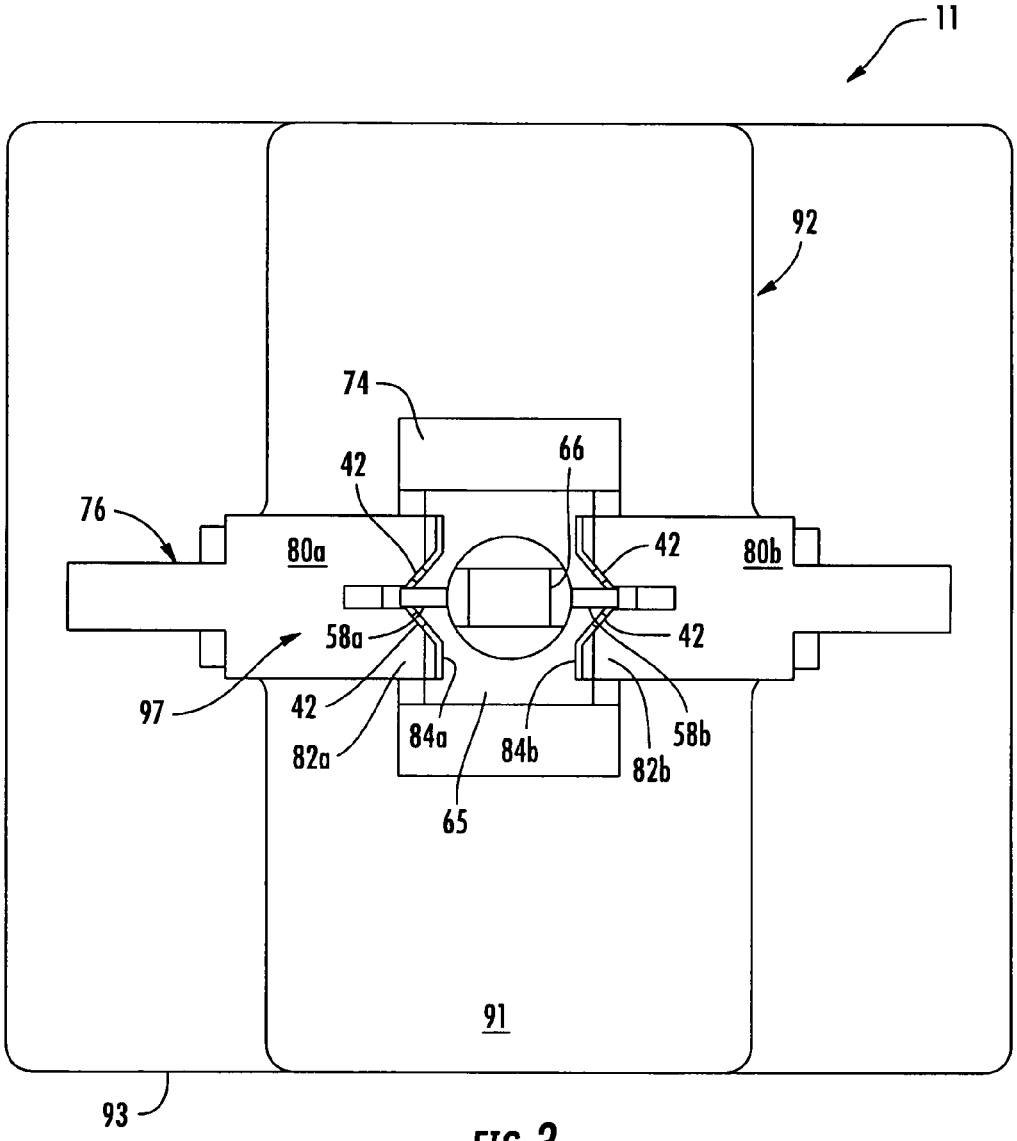
FIG. 3 is a top view of the OPC drum flange removal assembly of FIG. 2A without a top plate.

As shown in FIG. 3, the first C-shaped hand element 80*a* may comprise a first flange retaining end 82*a*. As further shown in FIG. 3, the first flange retaining end 82*a* preferably has a first contact end 84*a* that may make contact with the flange portion 14.

As further shown in FIG. 3, the second C-shaped hand element 80*b* may comprise a second flange retaining end 82*b*, and the second flange retaining end 82*b* preferably has a second contact end 84*b* that may make contact with the flange portion 14. The first contact end 84*a* and the second contact end 84*b* may preferably be in the form of a flexible pad 78 (see FIGS. 2A and 8). Each flexible pad 78 is preferably made of a protective, soft, flexible material, such as rubber or another flexible material, so that when the flexible pads 78 (see FIGS. 2A and 8) are in contact with the flange portion 14, the flange portion 14 is not damaged, for example, when the flange portion 14 is grasped or held by the first C-shaped hand element 80*a* and the second C-shaped hand element 80*b* of the flange portion retaining element 76.

As shown in FIG. 2A, the first C-shaped hand element 80*a* may further comprise a first claw portion contact end 88*a* that may make contact with the first base end 62*a* of the first claw portion 58*a*. As further shown in FIG. 2A, the second C-shaped hand element 80*b* may further comprise a second claw portion contact end 88*b* that may make contact with the second base end 62*b* of the second claw portion 58*b*.

As shown in FIG. 5A, the first C-shaped hand element 80*a* and the second C-shaped hand element 80*b* are adapted to grasp and secure the unlocked flange portion 28. The flange lock unlocking device 50 (see FIG. 2A) is designed to unlock the flange lock 22 (see FIG. 1A), so that the flange portion 14 (see FIG. 5A) is in an unlocked position 26 (see FIG. 5A).

FIG. 5B is a close-up view of the circled portion 5B of FIG. 5A. FIG. 5B shows the second claw portion 58*b* in an open position 98. As further shown in FIG. 5B, the second tip 60*b* of the second claw portion 58*b* is moved outwardly from the second flange lock portion 22*b* of the flange portion 14. As further shown in FIG. 5B, the second tip 60*b* is no longer in contact with the tip 44 of the notch portion 42 of the second flange lock portion 22*b*, and the flange portion 14 is now in an locked position 26 (see FIG. 5A).

The flange portion retaining element 76 (see FIG. 5A) secures the unlocked flange portion 28 (see FIG. 5A), so that a cylinder portion 16 (see FIG. 5A) can be or may be removed from the secured unlocked flange portion 28 (see FIG. 5A) to obtain a removed cylinder portion 30 (see FIG. 11A) and a removed flange portion 32 (see FIG. 11B).

As shown in FIG. 2A, the flange lock unlocking device 50 may further comprise a frame or housing portion 90 surrounding or housing one or both of the unlocking portion 52 and/or the base portion 74. The flange lock unlocking device 50 further comprises a power source 92 coupled to the flange lock unlocking device 50 and coupled to a base platform 93 (see FIG. 2A). The power source 92 may comprise an air compressor check valve device 91 (see FIG. 2A), an air pump device, a mechanical air valve device, a battery, an electrical device, a motorized device, a manual mechanical crank device, a solenoid device, a pneumatic device, a hydraulic device, or another suitable power source. The OPC drum flange removal assembly 11 may comprise a manual operation assembly or may comprise an automated operation assembly.

As shown in FIG. 2A, the flange lock unlocking device 50 may further comprise a top plate portion 94 (see also FIGS. 4, 7) coupled to the flange projection engagement end 54. The top plate portion 94 (see FIGS. 4, 7) preferably has an opening 96 (see FIGS. 4, 7) adapted to receive a flange projection end 36 (see FIGS. 1A, 2A) of the flange portion 14 (see FIGS. 1A, 2A).

Figure 4:
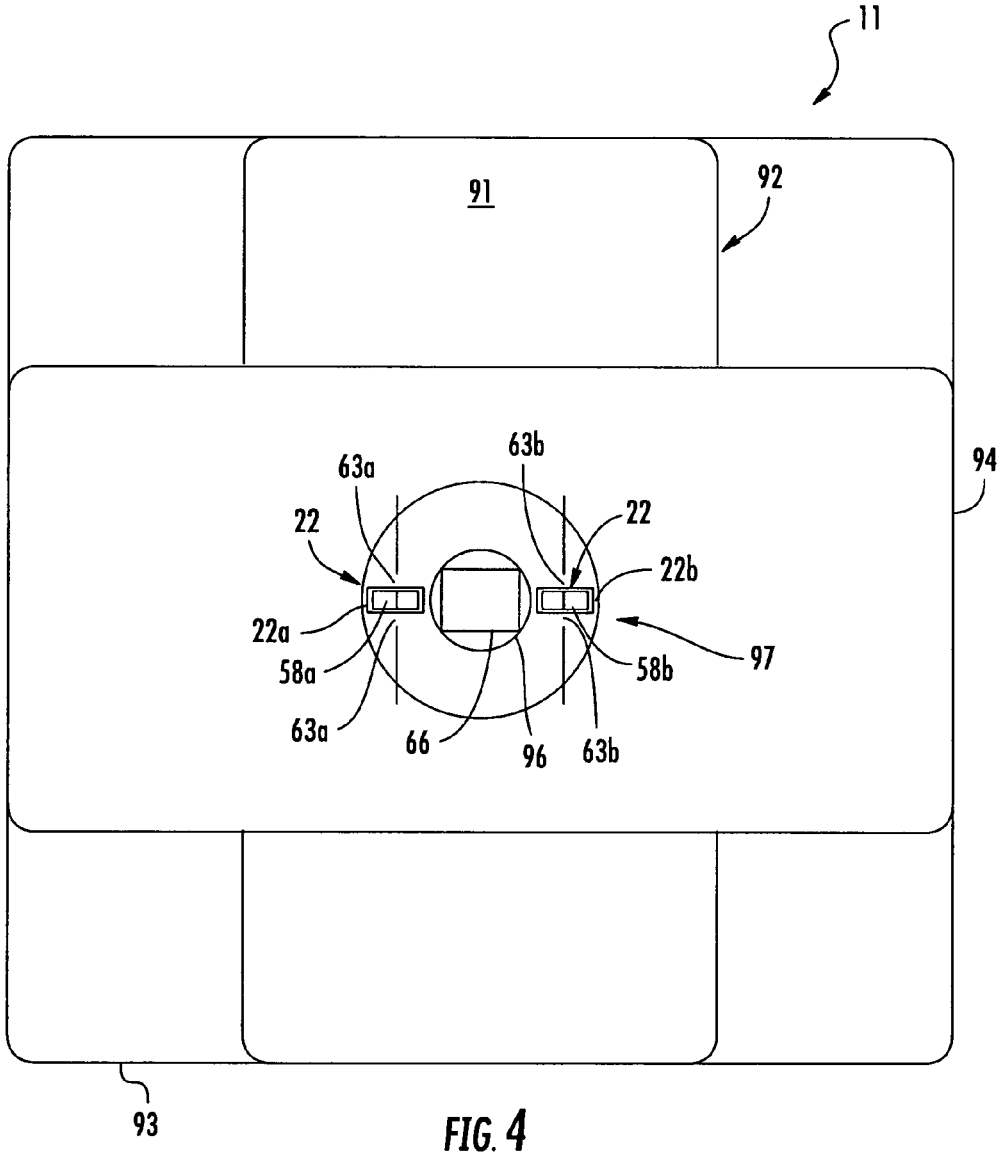
FIG. 4 is a top view of the OPC drum flange removal assembly of FIG. 2A with a top plate portion.
Figure 6:
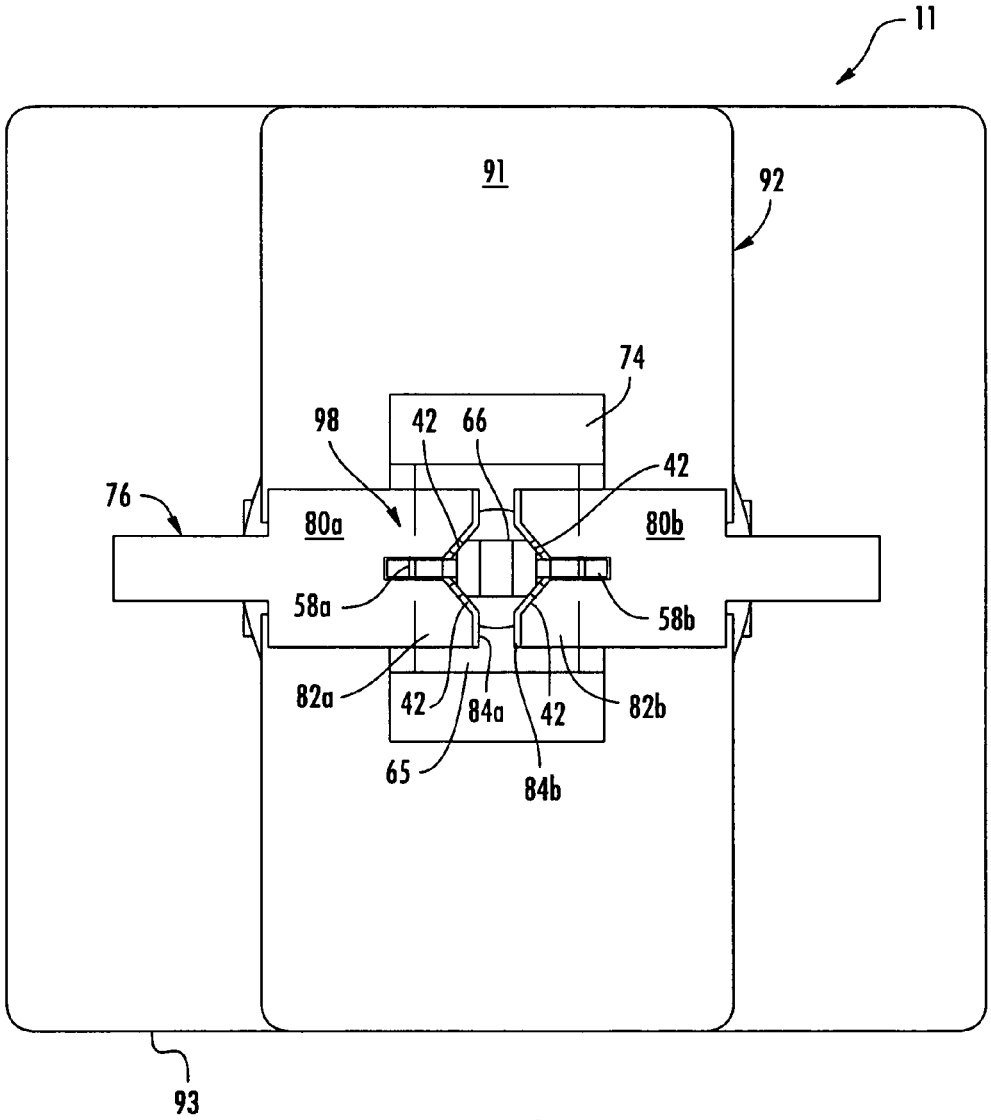
FIG. 6 is a top view of the OPC drum flange removal assembly of FIG. 5A without a top plate.
Figure 7:
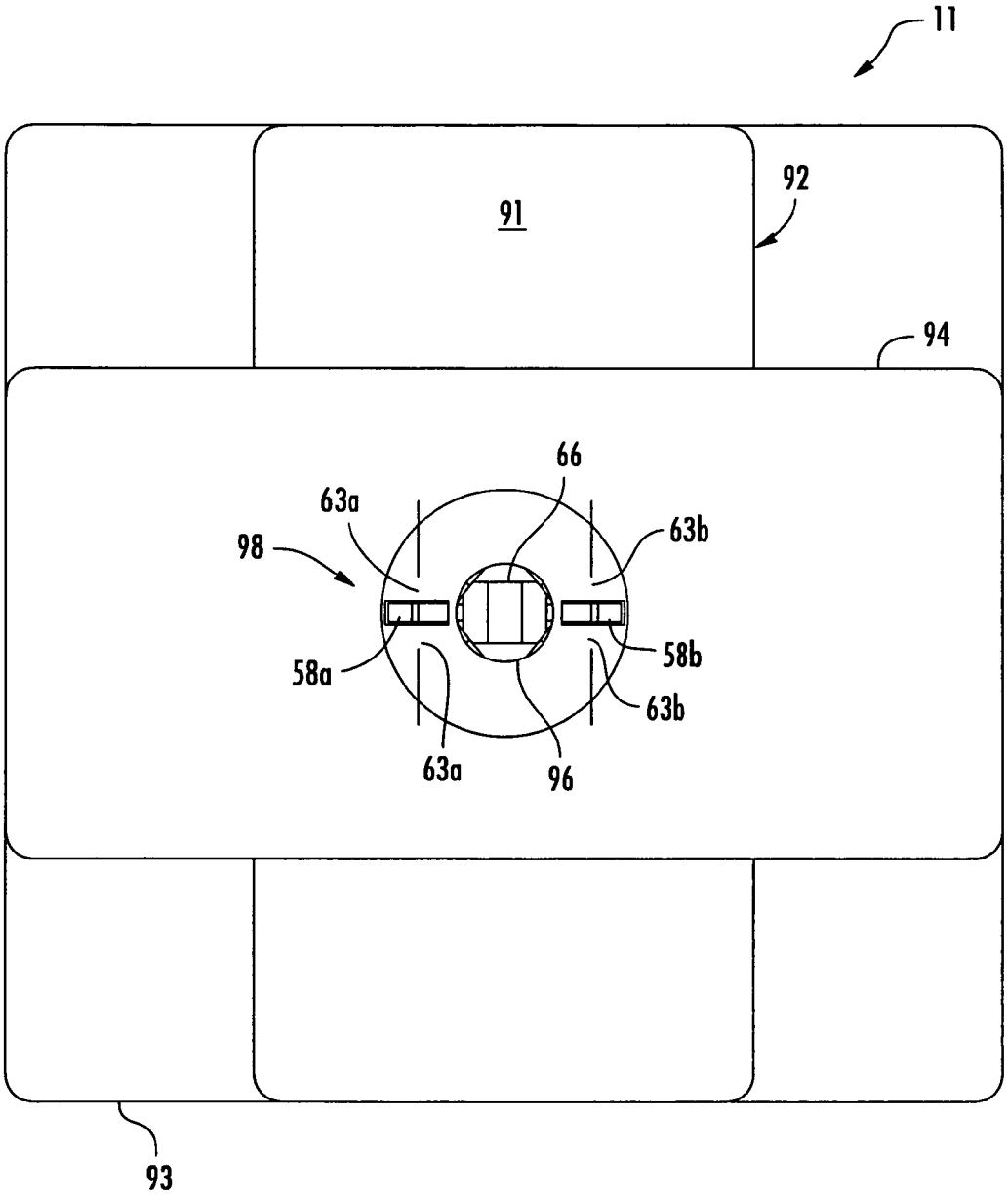
FIG. 7 is a top view of the OPC drum flange removal assembly of FIG. 5A with a top plate portion.

FIG. 4 is a top view of the OPC drum flange removal assembly 11 of FIG. 2A with a top plate portion 94. FIG. 7 is a top view of the OPC drum flange removal assembly 11 of FIG. 5A with a top plate portion 94. FIG. 3 is a top view of the OPC drum flange removal assembly 11 of FIG. 2A without a top plate portion 94. FIG. 6 is a top view of the OPC drum flange removal assembly 11 of FIG. 5A without a top plate portion 94.

Figure 14:
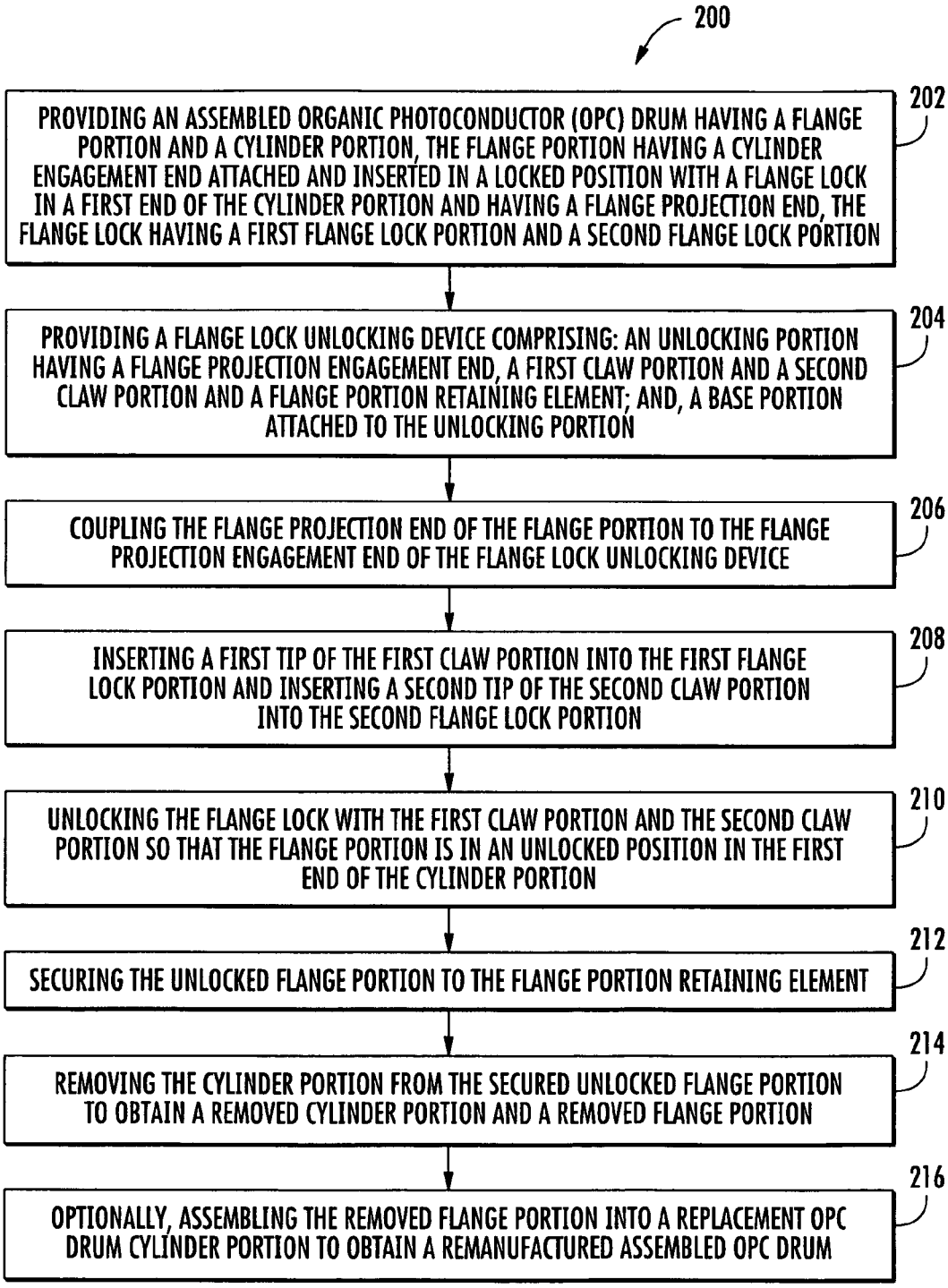

FIG. 14 is a flow diagram of one of the embodiments of a method 200 for removing a flange portion 14 (see FIG. 1A) of an assembled organic photoconductive (OPC) drum 12 (see FIG. 1A). As shown in FIG. 14, the method 200 comprises step 202 of providing an assembled organic photoconductor (OPC) drum 12 (see FIG. 1A) having a flange portion 14 (see FIG. 1A) and a cylinder portion 16 (see FIG. 1A). The flange portion 14 has a cylinder engagement end 18 (see FIG. 1A) attached and inserted in a locked position 20 (see FIG. 1A) with a flange lock 22 (see FIG. 1A) in a first end 24 (see FIG. 1A) of the cylinder portion 16 (see FIG. 1A). The flange portion 14 (see FIG. 1A) further comprises a flange projection end 36 (see FIG. 1A).

As shown in FIG. 1B, the flange lock 22 on the flange portion 14 preferably comprises a first flange lock portion 22*a* having a flange slot portion 23*a* and a cylinder slot portion 23*b*. As shown in FIG. 1C, the flange lock 22 on the flange portion 14 preferably comprises a second flange lock portion 22*b* having a flange slot portion 23*a* and a cylinder slot portion 23*b*. As shown in FIG. 1A, the first flange lock portion 22*a* is preferably positioned opposite the second flange lock portion 22*b*.

As shown in FIG. 14, the method 200 further comprises step 204 of providing a flange lock unlocking device 50. As shown in FIG. 14, the method 200 further comprises step 206 of coupling the flange portion 14, such as the flange projection end 36 (see FIG. 2A) of the flange portion 14, to the flange projection engagement end 54 of the flange lock unlocking device 50. As shown in FIG. 14, the method 200 further comprises step 208 of inserting the first tip 60*a* (see FIG. 2A) of the first claw portion 58*a* (see FIG. 2A) into the first flange lock portion 22*a* (see FIG. 2A) of the flange lock 22 (see FIG. 1A) and inserting a second tip 60*b* (see FIG. 2A) of the second claw portion 58*b* (see FIG. 2A) into the second flange lock portion 22*b* (see FIG. 2A) of the flange lock 22 (see FIG. 1A).

As shown in FIG. 14, the method 200 further comprises step 210 of unlocking the flange lock 22 (see FIG. 1A), such as the first flange lock portion 22*a* (see FIG. 5A), with the first claw portion 58*a* (see FIG. 5A), and such as the second flange lock portion 22*b* (see FIG. 5A), with the second claw portion 58*b* (see FIG. 5A), so that the flange portion 14 (see FIG. 5A) is in an unlocked position 26 (see FIG. 5A) in the first end 24 (see FIG. 1A) of the cylinder portion 16 (see FIG. 5A). The first claw portion 58*a* (see FIG. 5A) and the second claw portion 58*b* (see FIG. 5A) may preferably unlock the first flange lock portion 22*a* (see FIG. 5A) and the second flange lock portion 22*b* (see FIG. 5A), respectively, of the flange lock 22 (see FIG. 1A), using a force in a range of between about 20 kilogram-force (kgf) and about 30 kilogram-force (kgf).

As shown in FIG. 14, the method 200 further comprises step 212 of securing the unlocked flange portion 28 (see FIG. 5A) to a flange portion retaining element 76 (see FIG. 5A). As shown in FIG. 14, the method 200 further comprises step 214 of removing the cylinder portion 16 from the secured unlocked flange portion 28 (see FIG. 5A) to obtain a removed cylinder portion 30 (see FIG. 11A) and a removed flange portion 32 (see FIG. 11B). Preferably, the removed flange portion 32 (see FIG. 11B) is not damaged during the removal step 214 of the method 200.

Figure 12B:
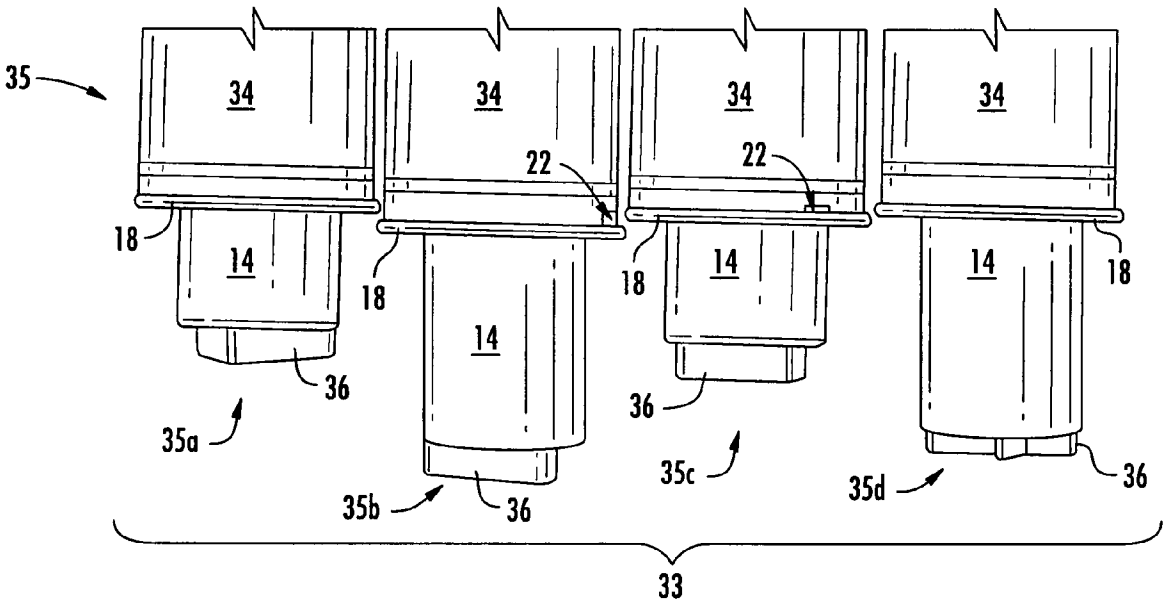
FIG. 12B is a top perspective view of the various remanufactured printer cartridge components of FIG. 12A.

As shown in FIG. 14, the method 200 may further optionally comprise step 216 of assembling the removed flange portion 30 (see FIG. 11B) into or with a replacement OPC drum cylinder portion 34 (see FIGS. 12A-12B) to obtain a remanufactured assembled OPC drum 35 (see FIGS. 12A-12B). The method 200 may further optionally comprise installing the remanufactured assembled OPC drum 35 (see FIGS. 12A-12B) into a laser printer cartridge (not shown) for use in a laser printer machine (not shown). The method 200 may further optionally comprise discarding or recycling the removed cylinder portion 30 (see FIG. 11A). The method 200 may comprise a manual method or an automated method.

Figure 8:
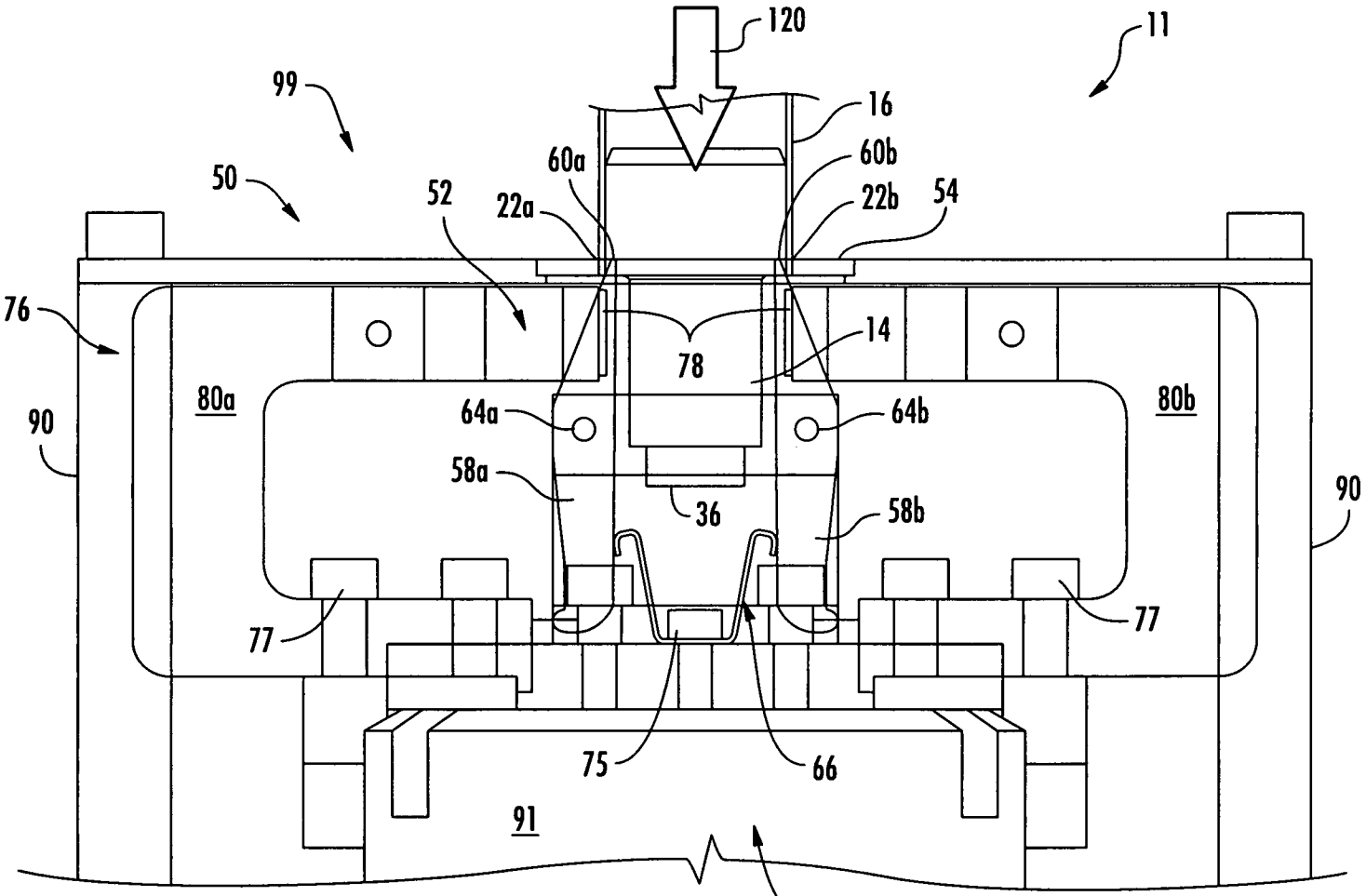
FIG. 8 is a side sectional view of an embodiment of an OPC drum flange removal assembly showing the flange lock unlocking device in a locked position.

FIG. 8 is a side sectional view of an embodiment of the OPC drum flange removal assembly 11 showing the flange lock unlocking device 50 in a locked position 99. As shown in FIG. 8, the first and second tips 60*a*, 60*b* of the first and second claw portions 58*a*, 58*b* are inserted into the first flange lock portion 22*a* and the second flange lock portion 22*b*, respectively. As shown in FIG. 8, the flange portion 14 attached to the cylinder portion 16 is inserted in a downward direction indicated by arrow 120 into the flange lock unlocking device 50 of the OPC drum flange removal assembly 11, so that the flange portion 14 is positioned substantially between the rubber pads 78 of the first and second C-shaped hand elements 80*a*, 80*b*.

Figure 9:
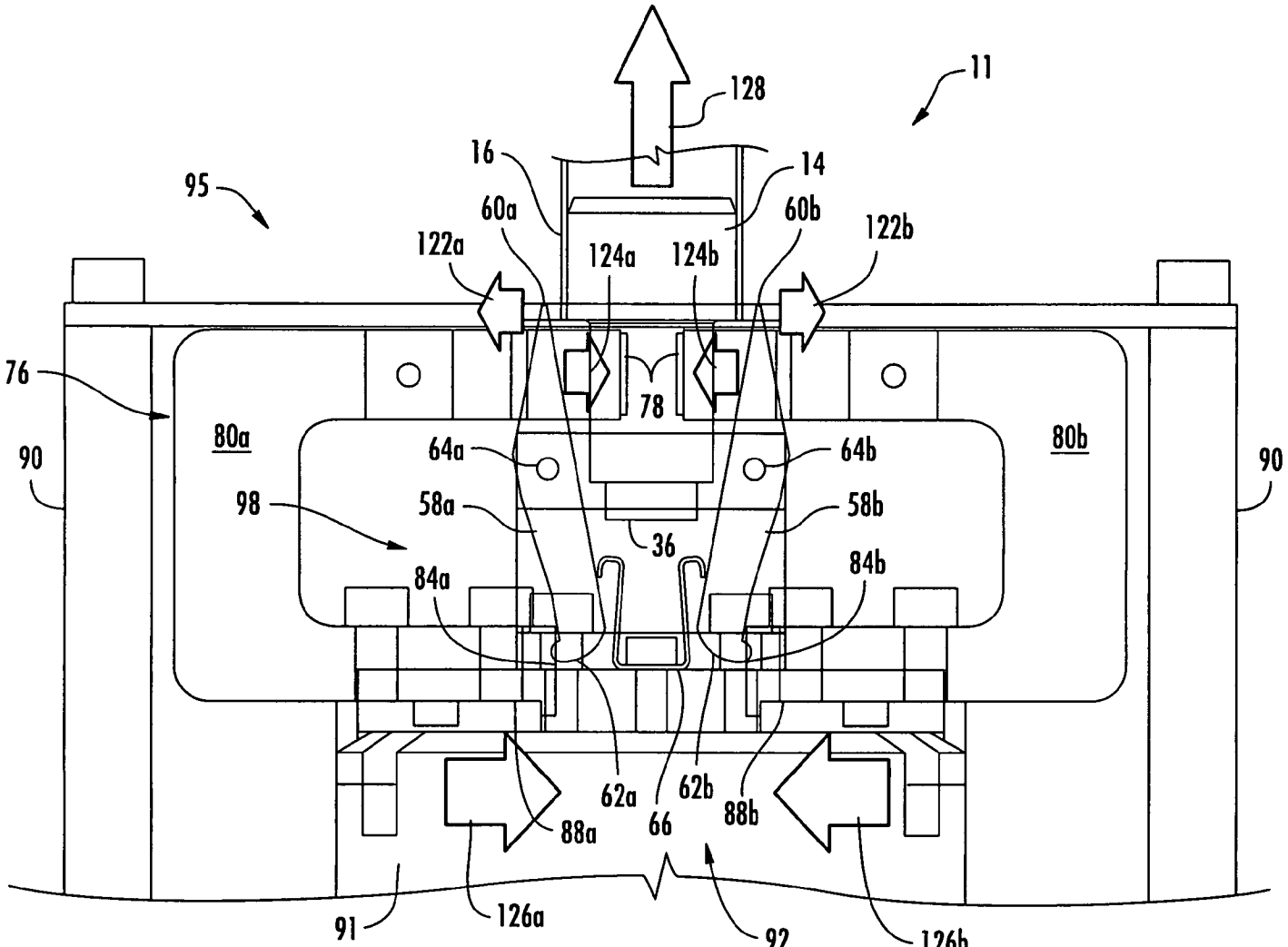
FIG. 9 is a side sectional view of the an OPC drum flange removal assembly of FIG. 8 showing the flange lock unlocking device in an unlocked position.

FIG. 9 is a side sectional view of the OPC drum flange removal assembly 11 of FIG. 8 showing the flange lock unlocking device 50 in an unlocked position 95. As shown in FIG. 9, for example, the power source 92 may preferably comprise an air compressor check valve device 91. As shown in FIG. 9, when an air valve (not shown) opens, the air compressor check valve device 91 is activated and the first and second C-shaped hand elements 80*a*, 80*b* are pushed toward the first and second claw portions 58*a*, 58*b* (see FIG. 9), respectively, by the force of the compressed air. The force of the compressed air is shown in inward directions indicated by arrows 126*a*, 126*b* in FIG. 9.

In particular, as shown in FIG. 9, the force of the compressed air moves the first contact end 84*a* of the first C-shaped hand element 80*a* against the first base end 62*a* of the first claw portion 58*a* so that the first claw portion 58*a* pivots on the first pivot element 64*a* and pivots the first tip 60*a* outwardly in an outward direction indicated by arrow 122*a*, causing the first tip 60*a* to unlock the first flange lock portion 22*a* (see FIG. 2A) of the flange lock 22 (see FIG. 1A). Further, as shown in FIG. 9, the force of the compressed air moves the second contact end 84*b* of the second C-shaped hand element 80*b* against the second base end 62*b* of the second claw portion 58*b*, so that the second claw portion 58*b* pivots on the second pivot element 64*b* and pivots the second tip 60*b* outwardly in an outward direction indicated by arrow 122*b*, causing the second tip 60*b* to unlock the second flange lock portion 22*b* (see FIG. 2A) of the flange lock 22 (see FIG. 1A).

The first and second C-shaped hand elements 80*a*, 80*b* (see FIG. 9) move inwardly in inward directions indicated by arrows 124*a*, 124*b* (see FIG. 9) to grasp the flange portion 14 (see FIG. 9). As shown in FIG. 9, the cylinder portion 16 (see FIG. 9) may be removed by pulling the cylinder portion 16 away from the flange portion 14 in an upward direction indicated by arrow 128.

Figure 10:
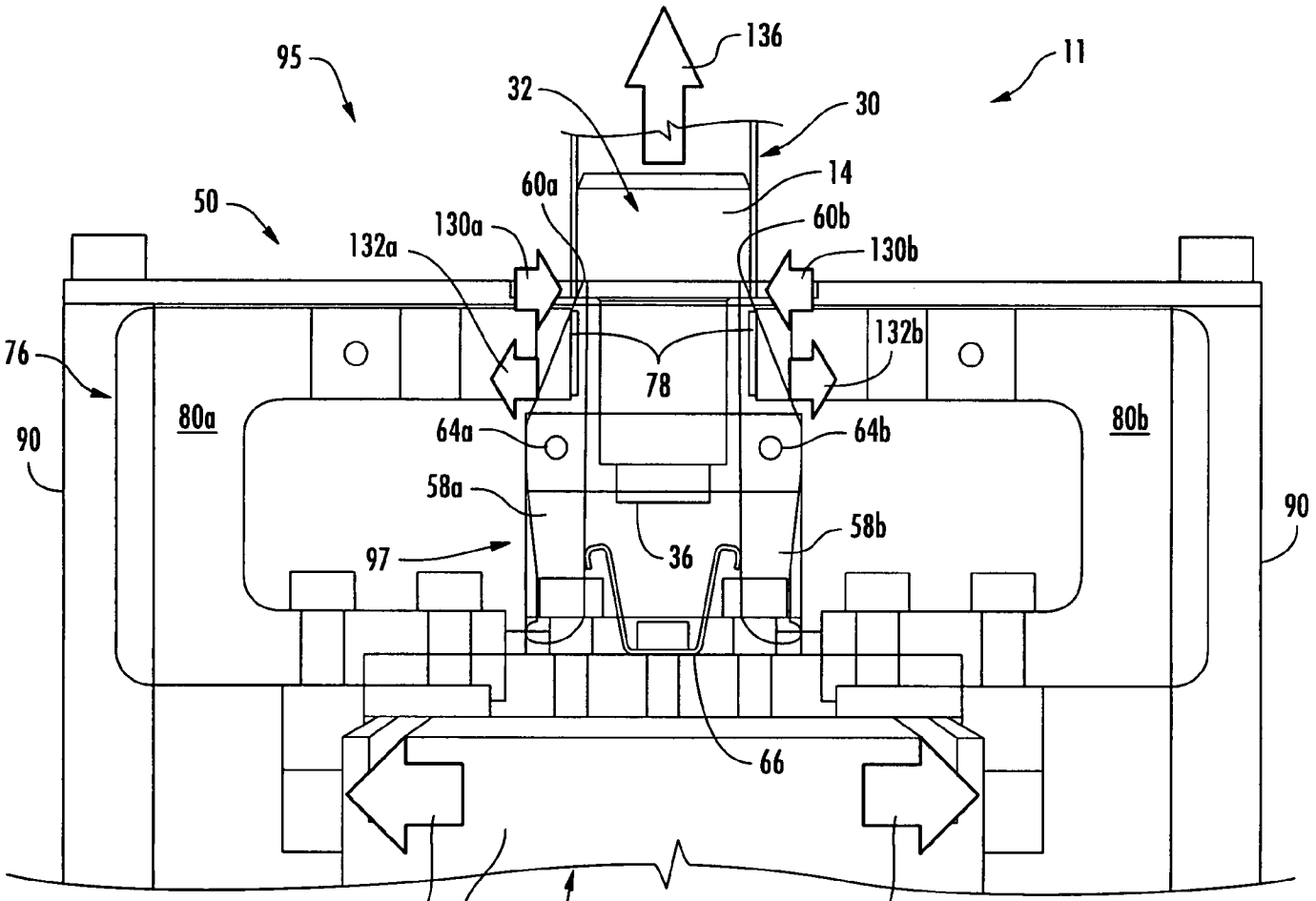
FIG. 10 is a side sectional view of the OPC drum flange removal assembly of FIG. 8 showing a removed flange portion after a removed cylinder portion has been removed.

FIG. 10 is a side sectional view of the flange lock unlocking device 50 of FIG. 8 showing a removed flange portion 32 after a removed cylinder portion 30 has been removed. As shown in FIG. 10, when the air valve (not shown) closes, the air compressor check valve device 91 is deactivated and the force of the compressed air is moved away and shown in outward directions indicated by arrows 134*a*, 134*b*.

As shown in FIG. 10, the first and second C-shaped hand elements 80*a*, 80*b* are pushed away from the first and second claw portions 58*a*, 58*b*, respectively, in outward directions indicated by arrows 132*a*, 132*b*, respectively. As further shown in FIG. 10, the first and second claw portions 58*a*, 58*b*, respectively, move in inward directions indicated by arrows 130*a*, 130*b*, and back to their original position in the OPC drum flange removal assembly 11.

As shown in FIG. 10, the flange portion 14 may be released from the OPC drum flange removal assembly 11 by pulling or removing the flange portion 14 in an upward direction indicated by arrow 136.

FIG. 11A is a top perspective view of the removed cylinder portion 30 completely disconnected or removed from the removed flange portion 32 (see FIG. 11B). FIG. 11A shows the first end 24 of the cylinder portion 16 with the first flange lock portion 22*a* with cylinder notch 23*b* and the second flange lock portion 22*b* with cylinder notch 23*b*.

FIG. 11B is a top perspective view of the removed flange portion 32 completely disconnected or removed from the removed cylinder portion 30. FIG. 11B shows the flange portion 14 with the drum cylinder engagement end 18 and the first flange lock portion 22*a* with flange notch 23*a*. FIG. 11B further shows no damage to the grounding plate 38, no damage to the contact portions 40 of the grounding plate 38 and no damage to the plastic walls 46 of the flange portion 14, such as the known OPC flange portion.

FIG. 12A is a front perspective view of various remanufactured printer cartridge components 33, such as in the form of remanufactured assembled OPC drums 35, for example, remanufactured assembled OPC drums 35*a*, 35*b*, 35*c*, and 35*d*, for color printing applications showing the flange portions 14, such as reused OPC flange portions, assembled with replacement OPC drum cylinder portions 34.

FIG. 12B is a top perspective view of the various remanufactured printer cartridge components 33, such as in the form of remanufactured assembled OPC drums 35, for example, remanufactured assembled OPC drums 35*a*, 35*b*, 35*c*, and 35*d*, of FIG. 12A having replacement OPC drum cylinder portions 34 attached to flange portions 14 via drum cylinder engagement ends 18.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting. Although specific terms are employed herein, they are used in a generic and descriptive sense only and for purposes of limitation. The invention is not limited in its application to the details of the construction and to the arrangement of the components set forth in the above description or as illustrated in the drawings.

What is claimed is:

1. A method for remanufacturing a printer cartridge component, the method comprising:

providing a printer cartridge component comprising an assembled organic photoconductor (OPC) drum having a flange portion and a cylinder portion, the flange portion having a cylinder engagement end attached and inserted in a locked position with a flange projection engagement portion of a flange lock in a first end of the cylinder portion;

unlocking the flange lock by moving the flange projection engagement portion in a radial direction so that the flange portion is in an unlocked position in the first end of the cylinder portion;

securing the unlocked flange portion;

removing the cylinder portion from the secured unlocked flange portion to obtain a removed cylinder portion and a removed flange portion; and, assembling the removed flange portion with a replacement OPC drum cylinder portion to obtain a remanufactured printer cartridge component.

2. The method of claim 1 further comprising installing the remanufactured printer cartridge component into a laser printer cartridge.

3. The method of claim 1 further comprising discarding or recycling the removed cylinder portion.

4. The method of claim 1 wherein the flange portion has a grounding plate with one or more contact portions.

5. The method of claim 1 wherein the flange lock comprises a first flange lock portion and a second flange lock portion, the first flange lock portion being positioned opposite the second flange lock portion.

6. The method of claim 1 wherein the removed flange portion is not damaged during the method.

7. The method of claim 1 wherein assembling the removed flange portion with the replacement OPC drum cylinder portion further comprises assembling the removed flange portion with the replacement OPC drum cylinder portion to obtain a remanufactured assembled OPC drum.

8. A method for removing a flange portion of an assembled organic photoconductive (OPC) drum, the method comprising:

providing an assembled organic photoconductor (OPC) drum having a flange portion and a cylinder portion, the flange portion having a cylinder engagement end attached and inserted in a locked position with a flange lock in a first end of the cylinder portion, and the flange portion further having a flange projection end, the flange lock having a first flange lock portion and a second flange lock portion;

providing a flange lock unlocking device comprising:

an unlocking portion having a flange projection engagement end, a first claw portion and a second claw portion, and a flange portion retaining element; and, a base portion attached to the unlocking portion;

coupling the flange projection end of the flange portion to the flange projection engagement end of the flange lock unlocking device;

inserting a first tip of the first claw portion into the first flange lock portion and inserting a second tip of the second claw portion into the second flange lock portion;

unlocking the flange lock with the first claw portion and the second claw portion so that the flange portion is in an unlocked position in the first end of the cylinder portion;

securing the unlocked flange portion to the flange portion retaining element; and, removing the cylinder portion from the secured unlocked flange portion to obtain a removed cylinder portion and a removed flange portion.

9. The method of claim 8 further comprising assembling the removed flange portion into a replacement OPC drum cylinder portion to obtain a remanufactured assembled OPC drum.

10. The method of claim 9 further comprising installing the remanufactured assembled OPC drum into a laser printer cartridge.

11. The method of claim 8 further comprising discarding or recycling the removed cylinder portion.

12. The method of claim 8 wherein the removed flange portion is not damaged during the method.

13. The method of claim 8 wherein the method is a manual method.

14. The method of claim 8 wherein the method is an automated method.

15. The method of claim 8 wherein the first claw portion and the second claw portion unlock the flange lock using a force in a range of between about 20 kilogram-force (kgf) and about 30 kilogram-force (kgf).

16. The method of claim 8 further comprising coupling a power source to the flange lock unlocking device and providing power during the unlocking of the flange lock with the first claw portion and the second claw portion, and during the securing of the unlocked flange portion to the flange portion retaining element.

17. An organic photoconductor (OPC) drum flange removal assembly for removing a flange portion from a cylinder portion of an assembled organic photoconductive (OPC) drum, the OPC drum flange removal assembly comprising:

a flange lock unlocking device comprising:

an unlocking portion comprising:

a flange projection engagement end adapted to receive a flange portion of an assembled OPC drum;

a first claw portion and a second claw portion both adapted to unlock a flange lock locking a flange portion to a cylinder portion of the assembled OPC drum in order to obtain an unlocked flange portion, and a flange portion retaining element having a first C-shaped hand element and a second C-shaped hand element adapted to grasp and secure the unlocked flange portion; and, a base portion attached to the unlocking portion;

a power source coupled to the flange lock unlocking device, wherein the flange lock unlocking device unlocks the flange lock, so that the flange portion is in an unlocked position, and further wherein the flange portion retaining element secures the unlocked flange portion, so that a cylinder portion can be removed from the secured unlocked flange portion to obtain a removed cylinder portion and a removed flange portion.

18. The assembly of claim 17 wherein the flange lock unlocking device further comprises a top plate portion coupled to the flange projection engagement end, the top plate portion having an opening adapted to receive a flange projection end of the flange portion.

19. The assembly of claim 17 wherein the power source comprises an air compressor check valve device, an air pump device, a mechanical air valve device, a battery, an electrical device, a motorized device, a manual mechanical crank device, a solenoid device, a pneumatic device, or a hydraulic device.

20. The assembly of claim 17 wherein the assembly comprises a manual operation assembly process or an automated operation assembly process.

* * * * *